United States Patent [19]

Sasaki et al.

[11] Patent Number: 4,593,667

[45] Date of Patent: Jun. 10, 1986

[54] ENGINE CONTROL DEVICE

[76] Inventors: Shoji Sasaki, Sawa-ryo, 467, Tabiko; Yasunori Mori, 2-18-9, Hashikabe, both of Katsuta-shi, Ibaraki-ken; Noboru Sugiura, 1360-27, Kasahara-cyo, Mito-shi, Ibaraki-ken, all of Japan

[21] Appl. No.: 713,534

[22] Filed: Mar. 19, 1985

[30] Foreign Application Priority Data

Mar. 19, 1984 [JP] Japan ..... 59-51010

[51] Int. Cl.[4] ..... F02B 3/00

[52] U.S. Cl. ..... 123/488; 123/494; 123/480

[58] Field of Search ..... 123/488, 494, 478, 480, 123/486

[56] References Cited

U.S. PATENT DOCUMENTS

| | | | |
|---|---|---|---|
| 4,235,204 | 11/1980 | Rice | 123/488 |
| 4,309,971 | 1/1982 | Chiesa | 123/486 |
| 4,461,261 | 7/1984 | Isomura | 123/486 |
| 4,551,803 | 11/1985 | Hosaka | 123/486 |

*Primary Examiner*—Ronald B. Cox

*Attorney, Agent, or Firm*—Antonelli, Terry & Wands

[57] ABSTRACT

The present invention relates to an engine control device adapted to determine a basic fuel feed rate (Tp) in response to signals from a suction air flow rate sensor (20) and an air-fuel ratio sensor (20), and thereafter a fuel feed rate (Ti). According to the present invention, suction air flow rates ($Q_{An-1}$, $Q_{An-2}$) are calculated first on the basis of the last and the next to last fuel feed rates (Tin−1, Tin−2). The coefficients (A, B) required to correct the properties of the suction air flow rate sensor (20) are computed on the basis of these suction air flow rates. In the present invention, a fuel feed rate is determined finally on the basis of these coefficients.

9 Claims, 4 Drawing Figures

ENGINE CONTROL DEVICE

FIELD OF THE INVENTION

This invention relates to a control device for internal combustion engines, such as gasoline engines for automobiles, and more particularly to an electronically-controlled engine control device adapted to measure the flow rate of a suction gas in an engine and thereby control the feed rate of a fuel.

BACKGROUND OF THE INVENTION

In an engine of an electronically-controlled fuel injection system, various data representing the operational condition thereof are obtained from sensors to control an injector (fuel injection valve) on the basis of these data, supply a fuel at a required feed rate and thereby maintain a predetermined air-fuel ratio thereafter called "the A/F."

To constantly maintain the correct A/F even when the properties of actuators for various sensors and an injector are very randomly, or vary with the lapse of time, a method of detecting an output A/F in an engine with an A/F sensor, such as an $O_2$ sensor, and then carrying out a closed loop control operation based on a feedback control operation has been used.

However, in this conventional closed loop A/F control system, response is delayed considerably, so that the A/F cannot be controlled in a transitional region in which the operating condition of the engine varies.

With a view to eliminating these inconveniences, an engine control device of the so-called learing control system has been proposed, which is shown in, for example, FIG. 4 in Japanese Patent Laid-Open No. 57029/1979 dated May 8, 1979. This engine control device is adapted to successively store control correction rates while the A/F is subjected to a closed loop control based on feedback control, and read these stored control correction rates and reflect them in an A/F control in a transitional region so that a proper A/F can be obtained even when the engine is in a transitional operational region.

A/F sensors including an $O_2$ sensor do not perform adequately in the full-load region of operation when the throttle is almost completely open. Therefore, it is necessary to interrupt closed loop A/F control which is based on a feedback control operation in the region of full-load operation. This conventional engine control device can not control an engine if results of closed loop A/F control based on feedback are reflected, in all operational regions of the engine.

An object of the present invention is to provide an engine control device which can reflect the results of closed loop A/F control based on feedback, sufficiently and accurately in all operational regions of an engine, and which can maintain an accurate A/F at all times.

As will be made clear, the present invention is characterized in that closed loop A/F control based on feedback, is applied to the property correction of a sensor which is adapted to measure the flow rate of a suction gas in an engine, to thereby expand these regions in which the results mentioned above are reflected.

DESCRIPTION OF THE PREFERRED EMBODIMENTS

Figure 1:
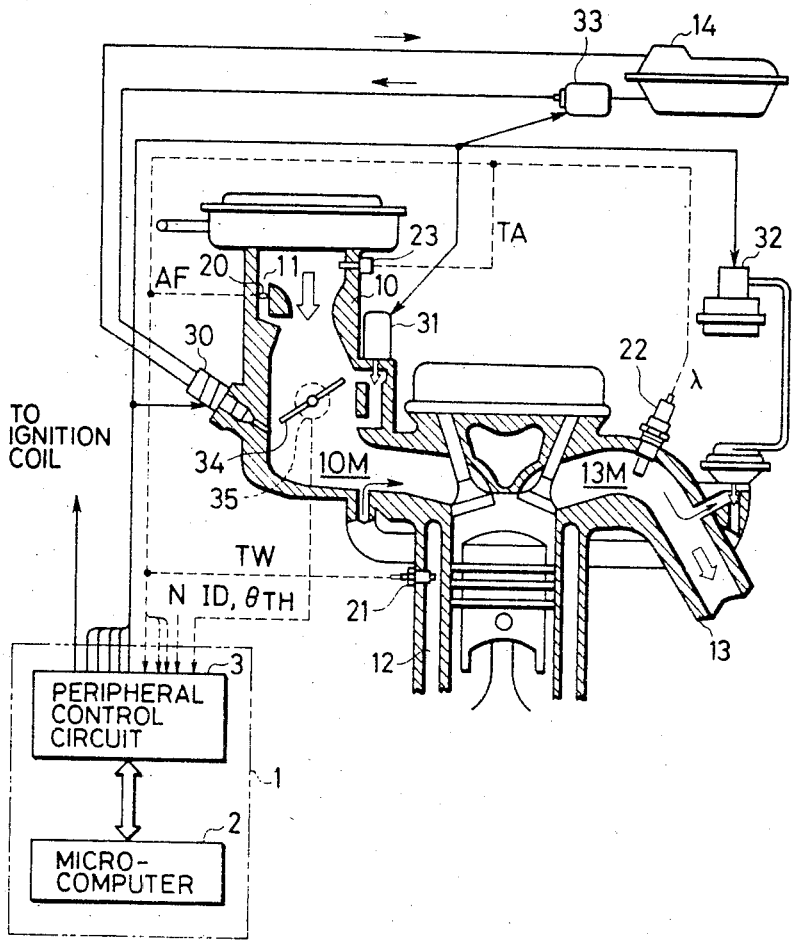
FIG. 1 shows an example of the construction of the engine control device according to the present invention.

FIG. 1 shows an engine control device of the present invention applied to a gasoline engine of the type in which fuel is injected into a suction pipe. Referring to the drawing, reference numeral 1 denotes an engine control device consisting of a microcomputer 2, and a peripheral control circuit 3, and adapted to receive the air flow rate data AF from AFS (air flow rate sensor), which is composed of a hot wire 20 provided in a bypass passage 11 in a suction pipe 10, the temperature data TW obtained from a water temperature sensor 21 provided in a cooling water passage 11 in the engine, the A/F ratio data λ obtained from an A/F ratio sensor 22 provided in an exhaust pipe 13 in the engine, the suction gas temperature data TA obtained from a section has temperature sensor 23 provided in the suction pipe 10, and the data N on the number of engine r.p.m., which are obtained from a revolution counter, a crank angle sensor, which is not shown. A control signal Ti, which is determined on the basis of these data, and which will be described later, is supplied to a fuel injection valve 30, a bypass valve 31, an EGR control valve 32, a fuel pump 33 and an ignition coil which is not shown. The fuel feed rate from fuel tank 14 controlled by fuel injection valve 30, the idling engine r.p.m. are controlled by the bypass valve 31, which controls the air flow rate during idling, EGR is controlled by the EGR control valve 32, which controls the circulation of exhaust gas, and the ignition is controlled by a microcomputer which supplies and cuts off an electric current to the ignition coil. The fuel pump 33 is controlled by a microcomputer so that it is operated only when a key switch for the engine is in the starting position or the engine is rotated by its own force.

A throttle valve 34 is provided with an angle sensor or a throttle switch 35, by which the data $Q_{TH}$ on the degree of opening of the throttle valve 34, or a signal 1D which is turned on when the throttle valve 34 is in an idling position, i.e., when the throttle valve 34 is in the return position with the accelerator pedal fully released is input to the microcomputer 2.

In the embodiment of FIG. 1, the fuel injection valve 30 is provided at the region of a suction air passage which is on the downstream side of the throttle valve 34. A system in which a fuel injection valve is provided on the upstream side of a throttle valve 34 is generally known. The present invention can be practiced in either of these systems.

Although FIG. 1 does not illustrate the engine in detail, almost all engines of this nature are so-called multi-cylinder engines which have a plurality of cylinders. It is therefore evident that a so-called manifold 10M is provided on the downstream side of a suction pipe with a manifold 13M provided on the upstream side of an exhaust pipe 13 in a similar manner.

The operation of this embodiment will now be described.

Microcomputer 2 in control device 1 is adapted to process the data AF from AFS, calculate a flow rate $Q_A$ of suction air per unit time, and determine the basic injection time $T_F$ for the fuel injection valve 30 on the basis of the flow rate $Q_A$ and the data N, which represent engine r.p.m., as:

$$T_F = K \cdot (Q_A)/N \quad (1)$$

where K is a constant determined by the fuel injection valve.

The basic injection time $T_F$ is then corrected with reference to the above-mentioned various kinds of data, for example, the data TW, TA and λ; the injection time Ti is determined as:

$$Ti = T_F \alpha \cdot (1 + K_{TW} + K_{TA}) \quad (2)$$

where $\alpha$ is the air-fuel ratio, i.e. a coefficient determined by λ; $K_{TW}$ is temperature read by the water temperature sensor in the cooling water passage in the engine, i.e. a correction coefficient based on the data TW; and $K_{TA}$ the suction air temperature obtained read by the suction air temperature sensor in the suction pipe, i.e. a correction coefficient based on the data TA.

In the control device 1, calculation of the injection time Ti by these formulae (1) and (2) are made at predetermined periods, for example, every 10 m/sec, or synchronously with the rotations of the engine and every predetermined number of rotations thereof. Thus, a new injection time Ti is determined successively to thereby open the fuel injection valve 30 and obtain a predetermined A/F. The injection operation by this fuel injection valve 30 is performed generally in synchronism with the rotation of the engine.

The coefficient $\alpha$ in the formula (2) is based on A/F data λ obtained from the air-fuel sensor 22. Since this coefficient $\alpha$ is included in the formula (2), the injection time Ti can be controlled to a level which enables closed loop A/F control based on feedback to be performed, and an A/F to be thereby accurately controlled. The scatter of accuracy and variations in properties with the lapse of time of the constituent parts are offset, so that A/F is accurately controlled at all times. As already stated, this closed loop A/F control based on feedback must be interrupted in the region in which the operational condition of the engine varies greatly as well as in the high operational output region. This control is carried out with the coefficient $\alpha$ set to a predetermined level, for example, 1.0.

Figure 2:
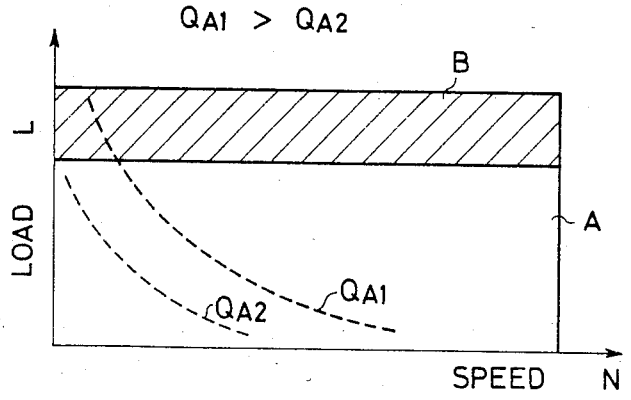
FIG. 2 is a diagram illustrating the operational regions of an engine.

FIG. 2 shows a region A, in which closed loop A/F control based on feedback is carried out, and a region B, in which this control is interrupted, with respect to an engine load L and the number N of engine r.p.m. The broken lines in the drawing denote the relation between the load L and the number N of revolutions with a flow rate $Q_A$ of suction gas used as a parameter.

The engine control device constructed as mentioned above is similar to a prior art engine control device, which can not perform feedback A/F control in all operational regions of the engine. In an embodiment of the present invention, a process shown in FIG. 3 including calculating the injection time Ti on the basis of the formulae (1) and (2) is carried out. Therefore, the results of correction by feedback A/F control are reflected in all operational regions of the engine, and A/F can be accurately controlled at all times in any operational condition. The process illustrated in the flow chart of FIG. 3 will now be described.

Figure 3:
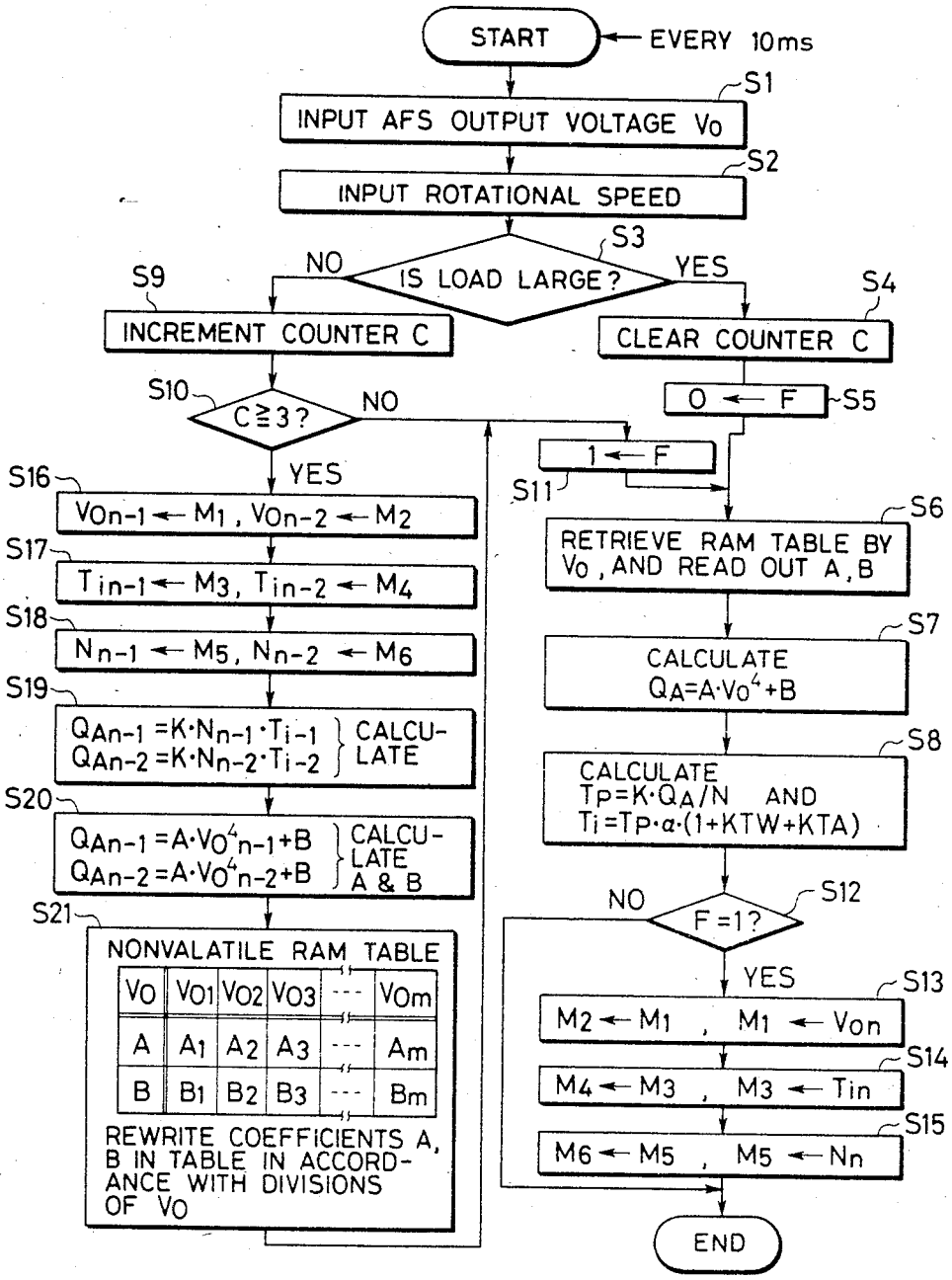
FIG. 3 is a flow chart of an operation of an embodiment of the present invention.

The process according to the flow chart of FIG. 3 is carried out repeatedly at intervals of, for example, 10 m/sec. First, in Steps S1, S2 (which will hereinafter be referred to simply as S1, S2 . . . omitting the term "Step"), the data Vo, N are taken in order, and then, the computation according to the formula (1) is done by the microcomputer 2 in S3 to ascertain that the engine load is in the region B in FIG. 2 or not. If "YES" is displayed, i.e., if the engine load is in the region B, a counter C, which is contained in the microcomputer 2 and adapted to count a successive number of entries of the engine load into the smaller region A, is cleared in S4. In S5, a flag F is set to zero so as not to rewrite a nonvolatile RAM table, which will be described later, in the microcomputer 2, and thereafter S6–S8 are carried out.

If "NO" is diaplayed after S3 has been carried out, i.e., if the operational condition of the engine is in the region A in FIG. 2, the counter C is incremented in S9. In S10, the value in the counter C is checked to determine whether it is 3 or more. If it is not, the flag is set to one in S11 so as to rewrite the nonvolatile RAM table. After S6–S8 have then been carried out, S13–S15 are carried out.

Only when the results in S10 are displayed as "YES", that is, only when the results of S3 are displayed as "NO" at least three consecutive times, S16–S21 are carried out.

S6–S8 are routine steps for calculating the injection time Ti for the fuel injection valve 30. In S6, coefficients A, B stored in the nonvolatile RAM table in the microcomputer 2 in S21, which will be described later, are read out on the basis of an output voltage Vo at AFS. In S7, a flow rate $Q_A$ is calculated with these coefficients A, B and date Vo. Finally, in S8, calculations according to formulae (1) and (2) are made to determine the injection time Ti. S6–S8 are always carried out regardless of the operational condition of the engine. When the process is carried out according to the flow chart, new injection time T, which corresponds to the flow rate of a suction gas in and the number of revolutions per minute of the engine, is calculated successively at intervals of 10 m/sec. The fuel injection valve 30 is controlled by Ti to enable the fuel to be supplied to the engine properly.

S13–S15 are routine steps of storing values Von−1, Tin−1, Nn−1 in the process just described, and values Von−2, Tin−2, Nn−2 in the process just before that, wherein Von, Tin, Nn represent the actual values of the data Vo, Ti, N. To carry out these steps, six memory regions M1–M6, which correspond to these values, are prepared in the microcomputer; the above data can be stored in the memory regions every time. S12 is the step of discriminating the flag F. When the results of S3 are displayed as "YES", S12 is carried out, and S13–S15 are not, after S6–S8 have been carried out. When the engine load is high, the final step is carried out immediately after S12.

S16–S21 are routine steps for determining two coefficients A, B, which are required for calculate the flow rate $Q_A$ of suction gas on the basis of an output voltage Vo at AFS, and then write these coefficients in the RAM table to conform with the division of the voltage Vo. In S16–S18, three kinds of six sets of data, Von−1, Von−2, Tin−1, Tin−2, Nn−1, Nn−2, which were stored in the memory regions M1–M6 in S13–S15 already carried out before S16–S18 are started, are read out. In S19, two sets of data $Q_{An-1}$, $Q_{An-2}$ on the flow rate of suction gas are calculated on the basis of the data Tin−1, Tin−2; Nn−1, Nn−2 out of the above-mentioned three kinds of data. In S20, two-dimensional simultaneous equations are solved by a microcomputer with these data, $Q_{An}$—1, $Q_{An}$—2; Von—1; Von—2 to determine the above coefficients A, B. In S21, these coefficients A, B are written in the regions provided corresponding to Vo divisions on RAM table.

Consequently, when the operations in S16–S21 are repeated, the constants A, B in the formula, $$Q_A = A \cdot Vo^4 + B \quad (3)$$

which is used to determine a flow rate $Q_A$ on the basis of an output voltage Vo at AFS, are calculated inversely on the basis of the data $Q_A$, Vo and applied to the RAM table (which consists of nonvolatile RAM), and they are stored corresponding to the divisions of the data Vo and refreshed.

A detailed form of the above formula (3) determines the flow rate $Q_A$ on the basis of the output voltage Vo at AFS is as follows.

$$Q_A = A \cdot Vo^4 + B \cdot Vo^3 + C \cdot Vo^2 + D \cdot Vo + E \quad (4)$$

wherein A, B, C, D and E are coefficients.

Since B, C and D in the formula (4) are nearly zero, the formula (3) is used in the description of the embodiment of the present invention.

To determine the flow rate $Q_A$ with the above formula (4) in the present invention, the coefficients A, B, C, D, E in the same formula are computed in S20 with the data obtained in the last five operations in S16–S18. These data can be rewritten as Von−1, Von−2, Von−3, Von−4, Von−5, Tin−1, Tin−2, Tin−3, Tin−4, Tin−5, Nn−1, Nn−2, Nn−3, Nn−4 and Nn−5. Predetermined memory regions M1–M15 must be prepared in the routine steps S13–S15.

Figure 4:
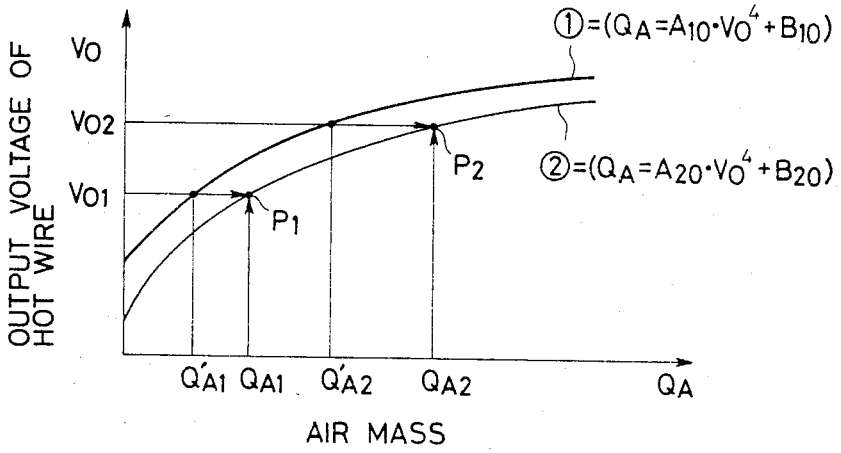
FIG. 4 is a characteristic diagram showing the relation between the flow rate of the air and the properties of an air flow rate sensor (hot wire) with time as a parameter.

We will now consider the case where flow rate $Q_A$ is calculated with coefficients $A = A_{10}$, $B = B_{10}$, which are set when the properties determined in accordance with the above formula (3) of AFS are as shown in FIG. 4(1). If the properties of AFS are actually as shown in FIG. 4(2) due to random nature of the values and variations with the lapse of time of the accuracy thereof, the flow rates with respect to the output voltages Vo1, Vo2 at AFS are detected as $Q_{A'1}$, $Q_{A'2}$, though they should normally be $Q_{A1}$, $Q_{A2}$; hence, the injection time Ti is not correctly calculated.

However, as referred to in the description of FIG. 1, when the engine is in the operational region shown in FIG. 2A, the coefficient $\alpha$ in the above formula (2) varies due to an output $\lambda$ from the A/F sensor 22, and the feedback control power by which the engine output A/F is controlled to a predetermined level is generated in practice. Consequently, the injection time Ti is set to a level which enables A/F to be correctly set, even if the coefficients A, B, which are required to determine the properties of AFS, have values $A_{10}$, $B_{10}$ corresponding to the properties shown in FIG. 4(1).

If the data $Q_{An-1}$, $Q_{An-2}$ are then determined on the basis of the data Tin−1, Tin−2 used while the A/F feedback control operation is carried out as shown in S19 and S20 in FIG. 3, the flow rate of the suction gas in the engine can be obtained. The properties shown in FIG. 4(2) of AFS can be determined by comparing data $Q_{A1}$ and $Q_{A2}$ and output voltages Vo1, Vo2 at AFS. If the coefficients A, B are calculated in S20, coefficients $A_{20}$, $B_{20}$ can be determined.

If the coefficients $A_1$–$A_m$, $B_1$–$B_m$ corresponding to these coefficients $A_{20}$, $B_{20}$ are written in S21 on the non-volatile RAM table in accordance with the divisions of Vo, injection time Ti is calculated with the coefficient read out from the RAM table as shown in S6, S7 in the drawing, $\alpha$ in the formula (2) is substantially maintained at one even in the region in which feedback A/F control is carried out. Even in the region in which a feedback A/F control is not carried out, a correct injection time Ti can always be obtained. The reason why the coefficients A, B are written in S21 corresponding to the divisions of the output voltage Vo at AFS are as follows. The properties of AFS do not always conform to the formula (2). If the coefficients A, B are determined according to the respective divisions, which are determined by dividing the value of the output voltage Vo at AFS, the correct properties of AFS can always be obtained whether the properties of AFS are in accordance with the formula (2) or not.

In the embodiment shown in FIG. 3, engine load only is determined in S3. It is preferable in practice that feedback A/F control be checked so as to carry out S9 with respect to only the region in which feedback A/F control is performed constantly.

In the above embodiment, only a hot wire AFS is shown but the AFS in the present invention is not limited thereto. It is evident that the present invention can be applied to a movable flap AFS and other arbitrary types of AFS's as well. Coefficients required to correct the properties of AFS may be set in accordance therewith.

In the above description, the data $Q_A$, which are obtained as the results of the correction with the coefficients A, B, are used as the data to determine an actual flow rate of the suction gas, to render the invention easily understandable. As is clear from the above statement, the correcting of the coefficients A, B is done after the output A/F has been kept in a proper level. Accordingly, the corrected values are displayed as corrected values of the data $Q_A$ which include the corrected values of variations in the properties of the actuators for the fuel injection valve 30 and other parts. Therefore, this embodiment corrects variations in the properties of not only the AFS but also the system as a whole, so that A/F can be accurately controlled at all times.

In the present invention, the results of closed loop A/F control based on feedback correctly setting A/F are reflected constantly in the correction of the properties of the suction gas flow rate sensor. The present invention eliminates the drawbacks in the prior art engine control device and controls A/F as accurately as feedback A/F control. This efficient operation is carried out in all operational regions of the engine including an operational region in which feedback A/F control has not been carried out. The present invention can provides an engine control device which controls A/F accurately and constantly without being influenced by random values and variations with the lapse of time of the properties of the constituent parts of the device.

What is claimed is:

1. An engine control device having a sensor for measuring flow rate of the suction air, a sensor for measuring an output air-fuel ratio, and adapted to determine a basic fuel feed rate on the basis of said flow rate of the suction air, and correct said basic fuel feed rate on the basis of said output air-fuel ratio, whereby a fuel feed rate is finally determined, comprising a means (S19) for calculating an actual flow rate of the suction air on the basis of said finally-determined fuel feed rate, a means (S20) for calculating on the basis of said actual flow rate of the suction air a coefficient which is required to correct the properties of said sensor (20) for measuring a flow rate of the suction air, a means (S7) for correcting said flow rate of the suction air on the basis of said coefficient before taking the data (Vo) on the flow rate of the suction air from said sensor (20) for measuring a flow rate of the suction air, and a means (S8) for determining a fuel feed rate (Ti) on the basis of a corrected flow rate ($Q_A$) of the suction air.

2. An engine control device according to claim 1, wherein said means for calculating the flow rate of the suction air consists of an arithmetic circuit adapted to compute a coefficient, which is required to correct the properties of said sensor (20), on the basis of the data on the recorded engine r.p.m. and the data on the recorded fuel injection time.

3. An engine control device according to claim 1, wherein said means for calculating a coefficient which is required to correct the properties of said sensor for measuring a flow rate of the suction air consists of an arithmetic circuit adapted to compute a coefficient, which is required to correct the properties of said sensor (20), on the basis of the data on the recorded flow rate of the suction air.

4. An engine control device according to claim 1, wherein said means for correcting said flow rate of the suction air consists of an arithmetic circuit adapted to compute a present flow rate ($Q_A$) on the basis of the present data (Vo) on the flow rate of the suction air and said coefficient.

5. An engine control device according to claim 1, wherein said means for determining a fuel feed rate consists of an arithmetic circuit adapted to determine an engine load ($Tp=K\cdot Q_A/N$, wherein N is the present engine r.p.m.), and thereafter compute said fuel feed rate ($Ti=Tp\cdot\alpha(1+K_{TW}+K_{TA})$, wherein $\alpha$ is a coefficient determined on the basis of the data $\lambda$ on an air-fuel ratio, $K_{TW}$ a correction coefficient based on the temperature data obtained from a water temperature sensor which is provided in a cooling water passage in said engine, and $K_{TA}$ a correction coefficient based on the suction air temperature data TA obtained from a suction air temperature sensor which is provided in a suction pipe).

6. An engine control device according to claim 1, wherein said means for calculating a coefficient which is required to correct the properties of said sensor for measuring a flow rate, which corresponds to various data (Vo1, Vo2, Vo3, . . . Vom) thereon, of the suction air has a memory (S21) for storing in a divided state a coefficient which is required to correct the properties of said sensor.

7. An engine control device according to claim 6, wherein said coefficient corresponding to said data in said memory on the flow rate of the suction air is rewritten when the engine load is low.

8. An engine control device according to claim 6, wherein said coefficient corresponding to said data in said memory on the flow rate of the suction air is not rewritten when the engine load is high.

9. An engine control device according to claim 6, wherein said coefficient corresponding to said data in said memory on the flow rate of the suction air is not rewritten immediately after the engine load varies from high to low.

* * * * *